US005877727A

United States Patent [19]

Saitou et al.

[11] Patent Number: 5,877,727

[45] **Date of Patent: *Mar. 2, 1999**

[54] GLASS ANTENNA DEVICE FOR AN AUTOMOBILE

[75] Inventors: Toshihiko Saitou, Kawasaki; Shotaro Takenobu, Kanagawa-ken, both of Japan

[73] Assignee: Asahi Glass Company Ltd., Tokyo, Japan

[ * ] Notice: The term of this patent shall not extend beyond the expiration date of Pat. No. 5,654,720.

[21] Appl. No.: 841,660

[22] Filed: Apr. 30, 1997

Related U.S. Application Data

[63] Continuation of Ser. No. 591,146, Jan. 25, 1996, Pat. No. 5,654,720, which is a continuation of Ser. No. 292,761, Aug. 19, 1994, abandoned.

[30] Foreign Application Priority Data

Aug. 20, 1993 [JP] Japan ..... 5-228306

[51] Int. Cl.[6] ..... H01Q 1/32

[52] U.S. Cl. ..... 343/713; 343/704

[58] Field of Search ..... 343/711, 713, 343/704, 712, 850, 860; H01Q 1/32, 21/30

[56] References Cited

U.S. PATENT DOCUMENTS

| | | | |
|---|---|---|---|
| 4,063,247 | 12/1977 | Sakurai et al. | 343/704 |
| 4,422,077 | 12/1983 | Kropielnicki | 343/704 |
| 4,491,844 | 1/1985 | Tsuchie et al. | 343/704 |
| 5,408,242 | 4/1995 | Nakase | 343/704 |
| 5,654,720 | 8/1997 | Saitou et al. | 343/704 |

OTHER PUBLICATIONS

U.S application No. 08/608,316, filed Feb. 28, 1996.
U.S. application No. 08/841,660, filed Apr. 30, 1997.

*Primary Examiner*—Hoanganh T. Le
*Assistant Examiner*—Tho Phan
*Attorney, Agent, or Firm*—Oblon, Spivak, McClelland, Maier & Neustadt, P.C.

[57] ABSTRACT

A glass antenna device for an automobile which has an electric heating type defogger, antenna conductors disposed near the defogger in a capacitive coupling relation, which are formed on a glass sheet to be fitted to a rear window opening of an automobile, and a reactance circuit connected between bus bars for the defogger and a d.c. power source for the defogger, wherein there is an anti-resonance point caused by impedance composed mainly of capacitance which is produced in correlation among the antenna conductors, the defogger and the body of automobile and the impedance of the reactance circuit, the anti-resonance point being out a predetermined receiving frequency band region or a predetermined broadcast frequency band region, and there is a resonance point between the frequency of 1.5 times of $f_H$ and $f_L$, where $f_H$ is the highest frequency in the predetermined receiving frequency band region or the predetermined broadcast frequency band region and $f_L$ is the lowest frequency of the same, which is caused by the impedance of a predetermined circuit connected between a power feeding terminal for the antenna conductors and a receiver; the input impedance of the receiver and the impedance of the antenna conductor side viewed from the predetermined circuit.

20 Claims, 9 Drawing Sheets

GLASS ANTENNA DEVICE FOR AN AUTOMOBILE

This is a Continuation of application Ser. No. 08/591,146 filed on Jan. 25, 1996, now U.S. Pat. No. 5,654,720, which is a Continuation of application Ser. No. 08/292,761 filed on Aug. 19, 1994, now abandoned.

BACKGROUND OF THE INVENTION

1. Field of the Invention

The present invention relates to a glass antenna device for an automobile having a high receiving sensitivity and flatness of receiving sensitivity within a desired broadcast frequency band region.

2. Discussion of the Background

In a glass antenna for receiving signals in an AM broadcast frequency band region (hereinbelow, referred to as an AM band) and an FM broadcast frequency band region (hereinbelow, referred to as an FM band), it has been known to insert a pre-amplifier at a desired position in a feeder line between a feeding terminal for an antenna conductor and a receiver to compensate an insufficient receiving sensitivity of the antenna. However, there occurred waveform distortion and cross modulation in a strong electric field due to the presence of the pre-amplifier to thereby amplify noises.

The conventional technique had problems as follows. Productivity decreased since it was necessary to dispose another pre-amplifier in addition to that for the receiver. Further, the pre-amplifier to be disposed near the glass antenna restricted the condition of designing an automobile, e.g. in obtaining a space for the pre-amplifier. Accordingly, it has been expected to develop a glass antenna device for an automobile having a high receiving sensitivity and non-directivity, and capable of suppressing noises, without the necessity of the pre-amplifier.

In order to eliminate the above-mentioned disadvantage, a glass antenna device disclosed in U.S. Pat. No. 5,083,134 is proposed. The publication discloses an antenna device for an automobile comprising an electric heating type defogger having heater strips and a bus bar for feeding a current to the heater strips and antenna conductors arranged to form a pattern wherein the defogger and the antenna conductors are formed on a glass sheet to be fitted to a rear window opening of an automobile, and wherein the defogger and the antenna conductors are disposed with a predetermined small space in a capacitive coupling relation so that an intermediate or a high frequency current is caused to flow but a direct current is not caused to flow between them, and a reactance circuit is connected between the bus bar and a d.c. power source for the defogger, whereby there is an anti-resonance point in a desired broadcast frequency band region, which is caused by impedance composed mainly of capacitance which is produced in correlation among the antenna conductors, the defogger and the body of automobile and the impedance of the reactance circuit, and there is a resonance point in the desired broadcast frequency band region, which is caused by the impedance of a predetermined circuit connected between a feeding terminal for the antenna conductors and a receiver, the input impedance of the receiver, and the impedance of the antenna conductor side viewed from the predetermined circuit.

In the proposed glass antenna device, however, it was difficult to make the receiving sensitivity flat in its entirety of the broadcast frequency band region because both the resonance point and the anti-resonance point exist in the broadcast frequency band region. If the construction of circuit was modified to reduce appropriately the value of Q (quality factor) so that the receiving sensitivity was made flat, the receiving sensitivity became worse.

Further, the existence of the anti-resonance point in the desired broadcast frequency band region decreased the S/N ratio by about several decibels (dB) in comparison with the existence of the anti-resonance point out of the desired broadcast frequency band region because noises are apt to occur near the anti-resonance point. However, the reason is not always theorically clear.

It is an object of the present invention to provide a glass antenna device for an automobile providing the characteristics of high gain, low noise level, non-waveform-distortion, non-cross-modulation and non-directivity, and excellent flatness of receiving sensitivity, without disposing a pre-amplifier.

In an aspect of the present invention, there is provided a glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, the glass antenna device being characterized in that:

there is an anti-resonance point caused by impedance composed mainly of capacitance which is produced in correlation among the antenna conductors, the defogger and the body of automobile and the impedance of the reactance circuit, the anti-resonance point being out of a predetermined receiving frequency band region or a predetermined broadcast frequency band region, and there is a resonance point between the frequency of 1.5 times of $f_H$ and $f_L$, where $f_H$ is the highest frequency in the predetermined receiving frequency band region or the predetermined broadcast frequency band region and $f_L$ is the lowest frequency of the same, which is caused by the impedance of a predetermined circuit connected between a power feeding terminal for the antenna conductors and a receiver; the input impedance of the receiver and the impedance of the antenna conductor side viewed from the predetermined circuit.

In another aspect of the present invention, there is provided the above-mentioned glass antenna device wherein the anti-resonance point is caused by impedance composed mainly of capacitance which is produced in correlation among the antenna conductors, the defogger and the body of automobile and the impedance of the reactance circuit in a lower frequency area out of the predetermined receiving frequency band region or the predetermined frequency band region.

In another aspect of the present invention, there is provided a glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, the glass antenna device being characterized in that:

there is an anti-resonance point between $(2/3)\cdot(f_L^2/f_H)$ and $f_L$ where $f_H$ is the highest frequency in a predetermined receiving frequency band region or a predetermined broadcast frequency band region and $f_L$ is the lowest frequency of the same, wherein the anti-resonance point is caused by impedance composed mainly of capacitance which is produced in correlation among the antenna conductors, the defogger and the body of automobile and the impedance of the reactance circuit, and is out of the predetermined receiving frequency band region or the predetermined broadcast frequency band region, and there is a resonance point between $f_L+(f_H-f_L)\cdot(0.3)$ and $(1.2)\cdot f_H$ wherein the resonance point is caused by the impedance of a predetermined circuit connected between a power feeding terminal for the antenna conductors and a receiver; the input impedance of the receiver and the impedance of the antenna conductor side viewed from the predetermined circuit.

In another aspect of the present invention, there is provided a glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, the glass antenna device being characterized in that:

there is an anti-resonance point between $f_{arL}+(f_L-f_{arL})\cdot(0.25)$ and $(0.9)\cdot f_L$ where $f_H$ is the highest frequency in a predetermined receiving frequency band region or a predetermined broadcast frequency band region, $f_L$ is the lowest frequency of the same, and $(2/3)\cdot(f_L^2/f_H)=f_{arL}$ and wherein the anti-resonance point is caused by impedance composed mainly of capacitance which is produced in correlation among the antenna conductors, the defogger and the body of automobile and the impedance of the reactance circuit, the anti-resonance point being out of the predetermined receiving frequency band region or the predetermined broadcast frequency band region, and there is a resonance point between $f_L+(f_H-f_L)\cdot(0.6)$ and $f_H$ wherein the resonance point is caused by the impedance of a predetermined circuit connected between a power feeding terminal for the antenna conductors and a receiver; the input impedance of the receiver and the impedance of the antenna conductor side viewed from the predetermined circuit.

DESCRIPTION OF THE PREFERRED EMBODIMENTS

Preferred embodiments of the glass antenna device of the present invention will be described with reference to the drawings.

Figure 1:
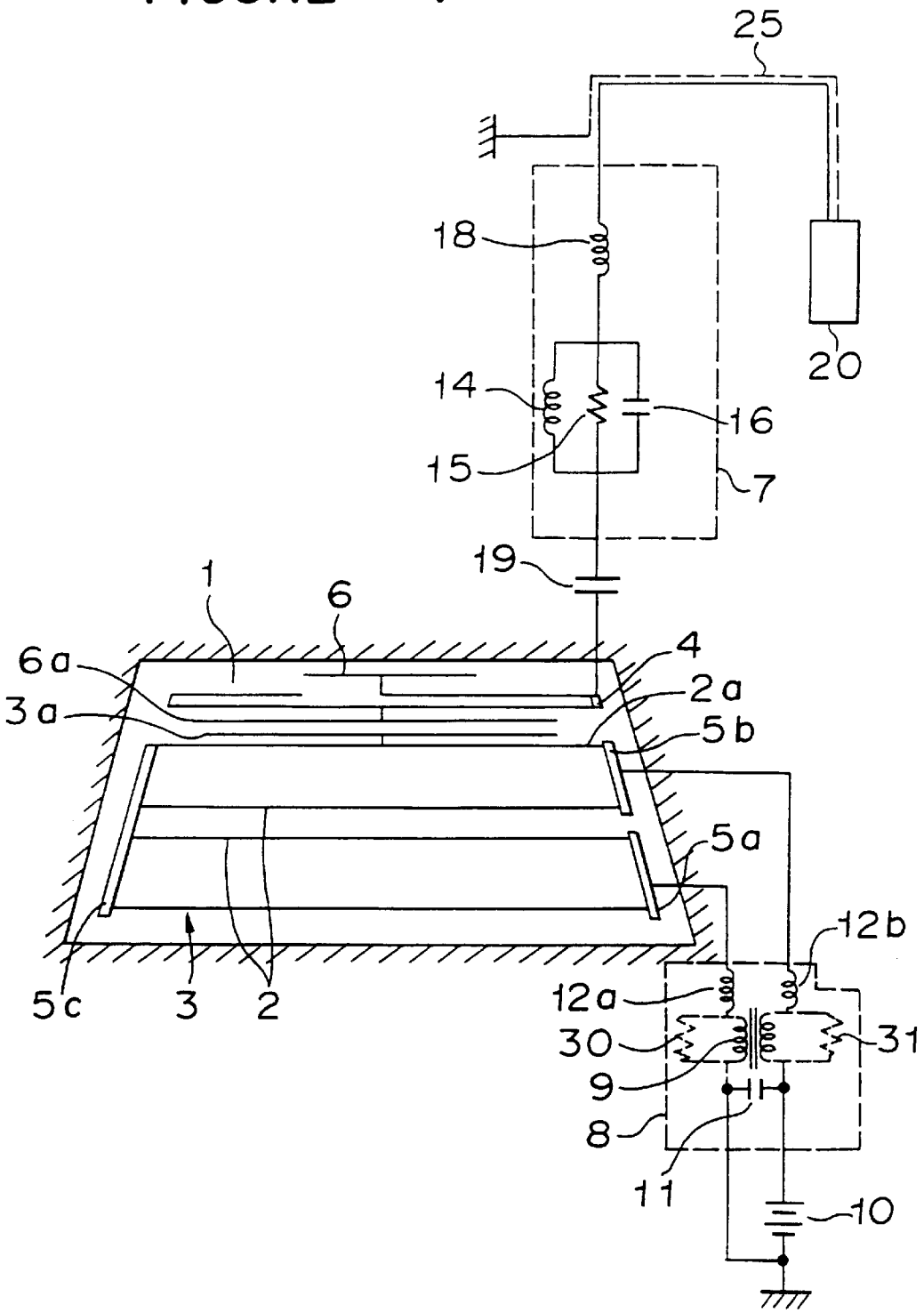
FIG. 1 is a diagram showing a typical example of the glass antenna device for an automobile according to the present invention.

FIG. 1 is a diagram showing a typical example of the glass antenna device for an automobile according to the present invention. In FIG. 1, reference numeral 1 designates a glass sheet fitted to a rear window opening of an automobile, numeral 2 heater strips, numeral 2*a* a heater strip at the highest position, numeral 3 a defogger, numeral 3*a* a branch line of the defogger, numeral 4 a feeding terminal for antenna conductors, numerals 5*a*, 5*b* and 5*c* designate bus bars, numeral 6 designates antenna conductors, numeral 6*a* an adjacent portion between an antenna conductors 6 and the defogger 3, numeral 7 a matching circuit as a predetermined circuit, numeral 8 a reactance circuit, numeral 9 a heater transformer, numeral 10 a d.c. power source, numeral 11 a capacitor, numerals 12*a* and 12*b* designate high frequency coils, numeral 14 designates a coil, numeral 15 a resistor, numeral 16 a capacitor, numeral 18 a coil for an FM band, numeral 19 a capacitor, numeral 20 a receiver, numeral 25 a cable and numerals 30 and 31 designate resistors.

As the glass sheet 1 of a rear window, a tempered glass sheet or a laminated glass sheet having a thickness of about 3 mm–5 mm is usually used. In a region to be heated of an inner side of the glass sheet 1 to be fitted to the rear window opening of an automobile, there is disposed the electric heating type defogger 3 comprising a number of the heater strips 2 and the bus bars 5*a*, 5*b* and the bus bar 5*c* which oppose each other and are connected between both ends of the heater strips. Lead wires are respectively connected to the bus bars 5*a*, 5*b* of the defogger 3.

The defogger 3 shown in FIG. 1 is so constructed that the bus bar disposed at a right side is sectioned vertically at a predetermined position to form the bus bar 5*a* of a lower side and the bus bar 5*b* of an upper side. The bus bar 5*a* of the lower side is connected with one of the lead wires for grounding the automobile body and the bus bar of the upper side 5*b* is connected with one of the lead wires at the power source side. An electric current flows in a ⊐-like form from the upper side bus bar 5*b* through the bus bar 5*c* to the lower side bus bar 5*a*.

With respect to the defogger 3 shown in FIG. 1, the defogger comprises the heater strips 2 and the bus bars 5*a*, 5*b*, 5*c*. The heater strips are so arranged that a number of electric heating type thin heater strips 2 each having a width of 0.5 mm–2 mm are formed on the glass sheet in the lateral direction in parallel to each other with intervals of 2 cm–4 cm. Further, the bus bars 5*a*, 5*b*, 5*c* are formed at both sides of the heater strips 2 so that a current can be supplied to the heater strips. The heater strips 2 and the bus bars 5*a*, 5*b*, 5*c* are usually prepared by printing paste including a conductive metal such as an electric conductive silver paste on an interior side of the glass sheet, followed by baking.

The antenna conductors 6 are formed in a space above the defogger 3 in the glass sheet in a case of FIG. 1. The adjacent portion 6*a* of the antenna conductors 6 and the branch line 3*a* of the defogger are disposed closely with a predetermined distance, whereby the antenna conductors 6 and the defogger 3 are connected in a capacitive coupling relation so that a direct current flows between them, but an intermediate or a high frequency current is not caused to flow between them.

The adjacent portion 6*a* of the antenna conductors 6 and the branch line 3*a* of the defogger are spaced apart with a distance of about 0.2 mm–30 mm, for instance. Accordingly, the defogger 3 functions as if it is a part of an antenna due to the capacitive coupling relation. In particular, the defogger 3 functions as a part of an antenna device for receiving signals for an AM broadcasting frequency region, and the effective length of the antenna device for the AM broadcasting is elongated whereby it can receive radio waves well and the receiving sensitivity is improved.

Further, in an FM band region, the opening portion of the automobile body to which the glass sheet 1 of the rear window is attached and the defogger 3 serve as a projector or a reflector to the antenna conductors 6. On the other hand, since a leak current flows to the opening portion of the automobile body and the defogger 3 from the antenna conductors 6, a loss of receiving signal from the defogger 3 can be prevented by the high frequency coils 12*a*, 12*b* whereby the receiving sensitivity is improved.

In the defogger 3 shown in FIG. 1, the branch line 3*a* is provided adjacent to the heater strip 2*a* at the highest position of the defogger 3. The branch line 3*a* of the defogger 3 assumes a substantially T character wherein it extends vertically from the middle portion of the highest heater strip 2*a* and branches laterally at a position near the adjacent portion 6*a* of the antenna conductors 6 as shown in FIG. 1. Since a current does not flow in the branch line 3*a*, noises are small. Further, the receiving sensitivity is improved due to the capacitive coupling between the antenna conductors 6 and the defogger 3.

The branch line 3*a* of the defogger may have any shape as far as it possesses the above-mentioned function, and is not limited to the shape shown in FIG. 1. For instance, it assumes such a shape that it extends vertically from a portion at the left or the right of the highest heater strip 2*a* and extends horizontally in the opposite direction at a position near the adjacent portion 6*a*. Further, the branch line 3*a* of the defogger can be substituted for a part of the heater strips 2 or a part of the bus bars 5*a*, 5*b*, 5*c*. In this case, the branch line 3*a* can be omitted. However, it is preferable to dispose the branch line 3*a* in order to suppress noises as stated above.

Figure 19:
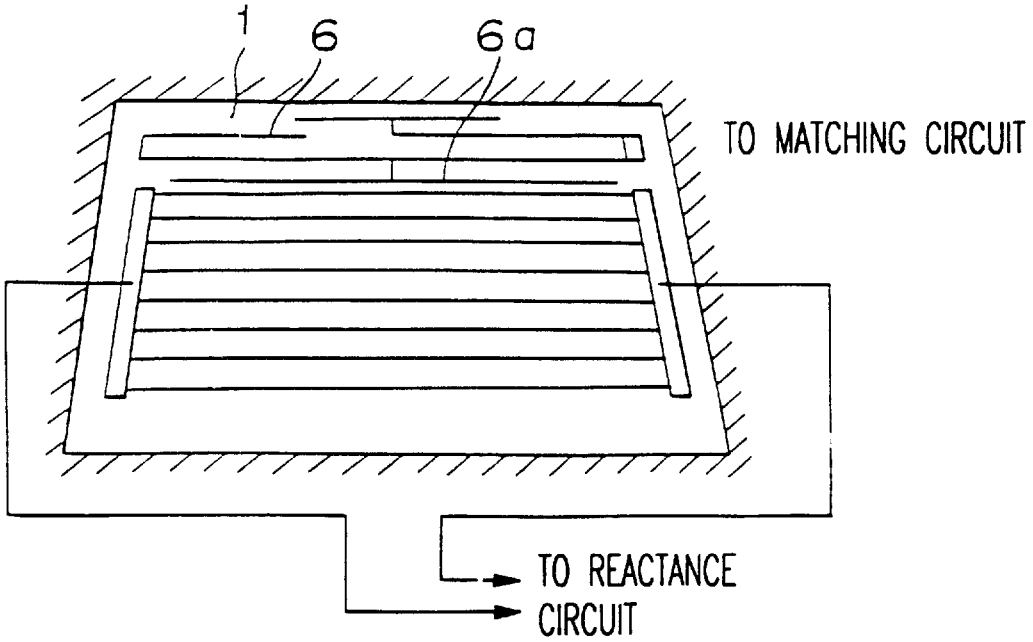
FIG. 19 is a front view of a defogger having a pattern different from that shown in FIG. 1.
Figure 20:
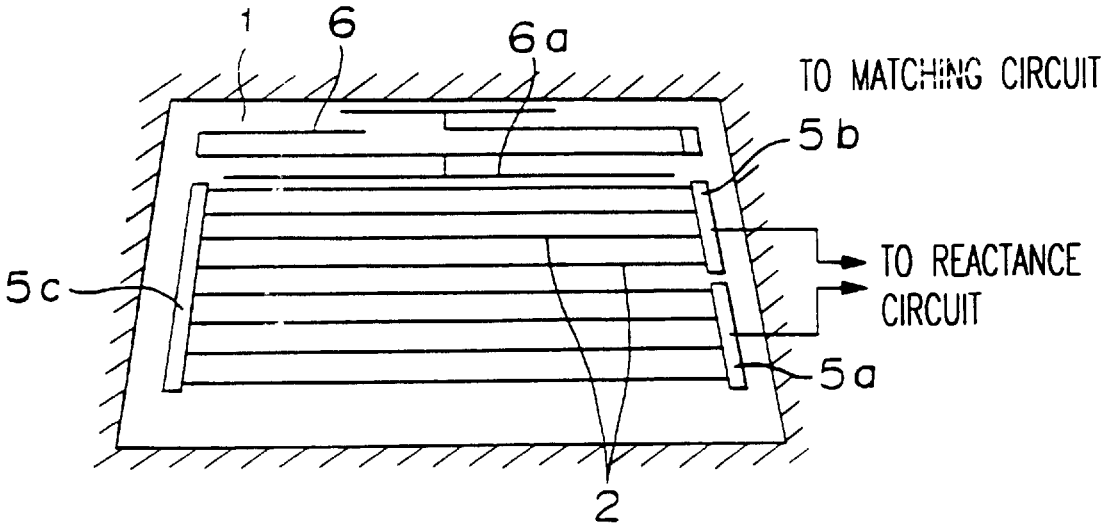
FIG. 20 is a front view of a defogger having a pattern different from that shown in FIG. 1.

FIGS. 19 and 20 are respectively front views of the defogger having different patterns from that in FIG. 1. Thus, the defogger applicable to the present invention is not limited to the one as shown in FIG. 1, but the defoggers shown in FIGS. 19 and 20 can also be applied to the present invention.

As described above, in order to connect the defogger 3 and the antenna conductors 6 in a capacitive coupling relation in at least their small portion, it is preferable to form the defogger 3 and the antenna conductors 6 on the same plane of the rear window glass on the cabin side of the automobile.

As to the pattern of the antenna conductors 6, it can be selected in a wide range depending on the shape of the automobile and the shape, the dimension and the construction of the glass sheet as far as it can provide the optimum performance as an antenna for an AM broadcast, an FM broadcast, an AM-FM broadcast and TV.

The position of the antenna conductors 6 on the glass sheet 1 will be described. FIG. 1 shows an example of the position of the antenna conductors 6 which are formed in a space above the defogger 3 on the glass sheet 1. However, the position is not limited to that shown in FIG. 1, but it may be formed in a space below the defogger 3. Further, it can be formed separately at upper and lower portions of the defogger, or it can be formed in another space.

In the present invention, the reactance circuit 8 is connected between the bus bars 5*a*, 5*b* and the d.c. power source 10 for the defogger to increase the impedance of the reactance circuit 8 in an intermediate or a high frequency band region so that a direct current from the d.c. power source 10 to the defogger 3 can be caused to flow but a current in an intermediate or a high frequency band region such as a broadcast frequency band region is interrupted. By connecting the reactance circuit 8, the heater strips 2 of the defogger 3 and the bus bars 5*a*, 5*b*, 5*c* can be electrically insulated from the ground for the automobile in terms of an intermediate or a high frequency band region whereby a receiving current in the intermediate or the high frequency band region such as a radio-wave-broadcasting frequency band region induced in the heater strips and the bus bars 5*a*, 5*b*, 5*c* can be prevented from flowing to the ground of the automobile, and the receiving current can be fed to the receiver 20 without any leakage.

In FIG. 1, the reactance circuit 8 is constituted by the heater transformer 9, the high frequency coils 12*a*, 12*b* and the capacitor 11 which may be added if necessary. Further, the resistors 30, 31 may be added if necessary. The construction of the reactance circuit 8 is not limited to that shown in FIG. 1, but it may have a desired design as far as it has a function to prevent the receiving current in the intermediate or the high frequency band region such as the radio-broadcasting frequency band region from flowing to the ground for the automobile body. For instance, when only signals in the AM band region are received, the reactance circuit 8 may be formed by only the heater transformer 9. When signals in only the FM band region are received, the reactance circuit 8 may be formed of only the high frequency coils 12*a*, 12*b*. When signals in both the AM band region and the FM band region are to be received, the reactance circuit 8 can be formed of only a coil if it has both functions of the heater transformer 9 and the high frequency coils 12*a*, 12*b*.

It is preferable that a choke coil in the heater transformer 9 in the reactance circuit 8 exhibits a relatively high impedance in an intermediate or a high frequency band region such as a radio broadcast frequency band region and prevents residual magnetism from leaving. For instance, there is a high frequency choke coil having a bifilar winding on a magnetic core (Mn—Zn ferrite or the like) in a toroidal-shape, a high frequency choke coil formed by winding a wire so as to cancel magnetic fluxes resulted by a current from a closed magnetic path, or a high frequency choke coil using a core having a high degree of magnetic saturation.

The choke coil of the heater transformer 9 can be so adjusted that in order to obtain inductance, self-resonance frequency and Q value required, a core is divided into two sections wherein the distance of the two core sections is adjusted, a predetermined capacitor is connected in parallel and the coil pitch is changed.

The resistors 30, 31 are dumping resistors to adjust the Q value of anti-resonance. Accordingly, the resistors 30, 31 can be omitted when an appropriate Q value is obtainable without the resistors. The resistors 30, 31 may be fixed resistor elements used generally in an electronic circuit or a semiconductor such as a transistor, a FET or the like.

The capacitor 11 in the reactance circuit 8 is to electrically short-circuit a current which causes noises and has a high frequency component (for instance, a current invading through the lead wires) in an intermediate or a high frequency band region such as a radio wave broadcast frequency band region. A filter may be disposed between the reactance circuit 8 and the d.c. power source 10 instead of disposing the capacitor 11.

The high frequency coils 12*a*, 12*b* in the reactance circuit 8 exhibit a high impedance in the FM band region. Accordingly, a solenoid without magnetic core or a magnetic core is generally used. These elements exhibit an inductive inductance in or near the FM band region. Further, the high frequency coils 12*a*, 12*b* may have lead wires having an appropriate length. Furthermore, the same effect is obtainable by disposing the reactance circuit 8 at an appropriate location in the cabin. The choke coil of the heater transformer 9 has a low self-resonance frequency in the FM band region and loses its inductance. Accordingly, the high frequency coils 12*a*, 12*b* are used instead of the choke coil.

In the present invention, the matching circuit 7 as a predetermined circuit is inserted in a predetermined position between the power feeding terminal 4 for the antenna conductors 6 and the receiver 20 so that resonance is effected in an intermediate or a high frequency current induced in the antenna conductors 6 due to the impedance of the matching circuit 7, the input impedance of the receiver 20 and the impedance of the antenna conductors viewed from the matching circuit, whereby the resonance current is supplied to the receiver 20.

The matching circuit 7 shown in FIG. 1 is a circuit constituted by the coils 14, 18, the capacitor 16 and the resistor 15. However, a desired circuit can be used as far as it produces a predetermined resonance. In the matching circuit 7 shown in FIG. 1, the impedance characteristic is determined by the coil 14, the capacitor 16 and the resistor 15 in the AM band region. The resistor 15 is a damping resistor for adjusting Q for resonance. The resistor 15 may be omitted when it is unnecessary to adjust Q.

Since the self-resonance frequency of the coil 14 is low in the FM band region, the coil 14 can be considered to have a capacitive reactance, and the coil 14 can be neglected. In the FM band region, the coil 18 contributes to cause a predetermined resonance. Accordingly, the coil 18 is unnecessary when signals in the FM band region are not received.

The matching circuit 7 has also a function of impedance-matching between the input of the receiver 20 and the power feeding terminal 4 of the antenna conductors. Further, the predetermined circuit as described before is referred to such one without having the function of impedance matching.

Thus, in the FM band region, the coil 18 contributes to determine the impedance characteristic. Thus, the coil 18 may be a coil having a core composed of Ni—Zn ferrite, a solenoid coil or a spiral coil, or a coil in which the inductance of a lead wire used for connecting the matching circuit is utilized.

As described above, the antenna conductors and the defogger 3 are usually formed by printing electric conductive silver paste on the glass sheet followed by baking it. In this case, there may occur migration of silver printed on the glass sheet between the adjacent portion 6*a* and the branch line 3*a* to thereby cause a short circuit. When the short circuit takes place, a large current flows into the receiver 20. In order to prevent the large current from flowing, the capacitor 19 for blocking a direct current may be inserted between the power feeding terminal 4 of the antenna conductors 6 and the matching circuit 7.

Figure 21:
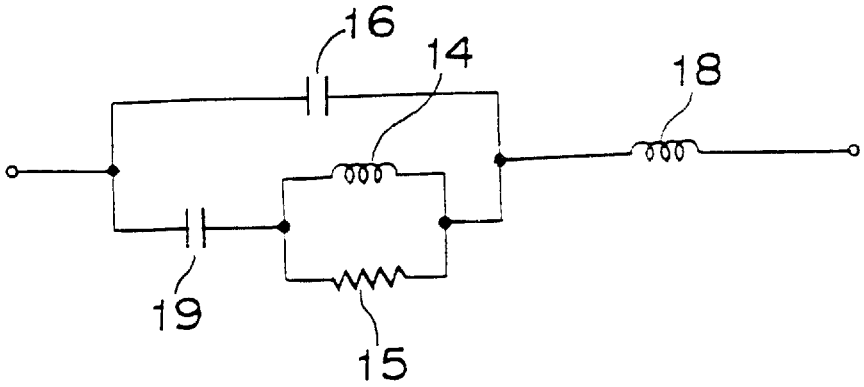
FIG. 21 is a circuit diagram of a matching circuit and the periphery thereof having the construction different from that shown in FIG. 1.
Figure 22:
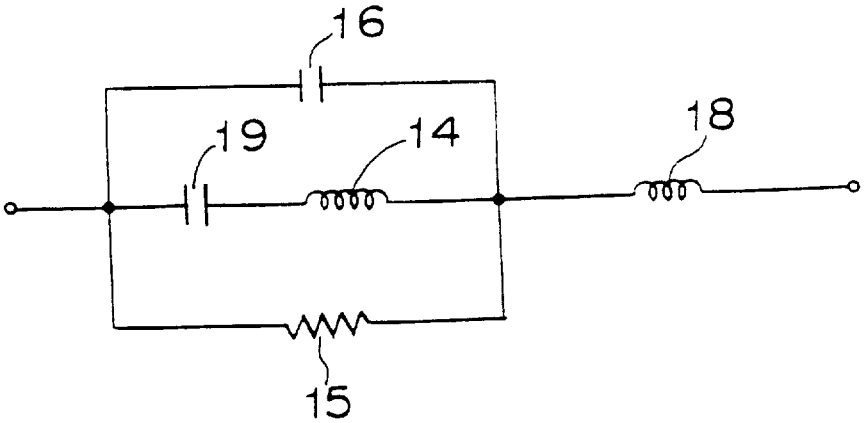
FIG. 22 is a circuit diagram of a matching circuit and the periphery thereof having the construction different from that shown in FIG. 1.

Wiring for the capacitor 19 and the matching circuit 7 shown in FIG. 1 can be modified as shown in FIG. 21 or FIG. 22. In FIGS. 21, 22, the same reference numerals as in FIG. 1 designate the same or corresponding parts having substantially the same functions as in FIG. 1. In FIGS. 21 and 22, the capacitor 19 is a capacitor for blocking a direct current, and it may be omitted under certain conditions.

In FIGS. 21 and 22, the coil 18 becomes unnecessary when signals in the FM band region are not received because the coil 18 contributes to cause a predetermined resonance in the FM band region in the same manner as the case of FIG. 1. Further, the impedance characteristic is determined by the coil 14, the capacitor 16 and the resistor 15 in the AM band region. The resistor 15 is a so-called damping resistor for adjusting Q for resonance. Accordingly, the resistor 15 can be omitted when the adjustment of Q is unnecessary.

In addition, description will be made as to how the matching circuit 7 is adjusted. In the present invention, it is necessary that there is an anti-resonance point caused by impedance composed mainly of capacitance which is produced in correlation among the antenna conductors, the defogger and the body of automobile and the impedance of the reactance circuit, the anti-resonance point being out of a predetermined receiving frequency band region or a predetermined broadcast frequency band region, and there is a resonance point between the frequency of 1.5 times of $f_H$ and $f_L$, where $f_H$ is the highest frequency in the predetermined receiving frequency band region or the predetermined broadcast frequency band region and $f_L$ is the lowest frequency of the same, which is caused by the impedance of a predetermined circuit connected between a power feeding terminal for the antenna conductors and a receiver; the input impedance of the receiver, and the impedance of the antenna conductor side viewed from the predetermined circuit.

When the anti-resonance point and the resonance point are out of the above-mentioned specified ranges, it is difficult to make the receiving sensitivity flat in the predetermined receiving frequency band region. When the anti-resonance point exists in the predetermined receiving frequency band region or the predetermined broadcast frequency band region, noises are apt to occur near the anti-resonance point although the reason is not always clear. Accordingly, the S/N ratio will decrease by several decibels (dB) in comparison with a case that the anti-resonance point exists out of the predetermined receiving frequency band region.

When the receiving sensitivity is to be improved by several decibels, it is preferable to produce a resonance point in a low region (a low frequency region than the broadcast frequency band region) out of the predetermined receiving frequency band region or the predetermined broadcast frequency band region.

Further, when the resonance point and the anti-resonance point are so adjusted that there is the anti-resonance point between $(2/3)\cdot(f_L^2/f_H)$ and $f_L$ where $f_H$ is the highest frequency in the predetermined receiving frequency band region or the predetermined broadcast frequency band region and $f_L$ is the lowest frequency of the same and there is the resonance point between $f_L+(f_H-f_L)\cdot(0.3)$ and $(1.2)\cdot f_H$, the flatness characteristic of the receiving sensitivity can be improved by at least about 1–2 dB preferably.

Further, when the anti-resonance point exists between $f_{arL}+(f_L-f_{arL})\cdot(0.25)$ and $(0.9)\cdot f_L$ where $(2/3)\cdot(f_L^2/f_H)=f_{arL}$ and the resonance point exists between $f_L+(f_H-f_L)\cdot(0.6)$ and $f_H$, the flatness characteristic of the receiving sensitivity can be improved by at least about 1–2 dB. Here, the flatness characteristic of the receiving sensitivity means that the difference between the highest receiving sensitivity and the lowest receiving sensitivity in a band region such as the predetermined broadcast frequency band region is small and flat.

When a usable range of the resonance point and the anti-resonance point is to be obtained, for instance, in the AM band region and the FM band region in accordance with the above-mentioned calculating formulas, the range as shown in Table 1 is obtainable. In Table 1, only intermediate AM and FM band regions are shown. However, a necessary range for the resonance point and the anti-resonance point can be determined with respect to a short wave and a long wave similarly.

TABLE 1

| Broadcast frequency band region | | Necessary range | Preferable range | More preferable range | Particularly preferable range |
|---|---|---|---|---|---|
| AM (530–1605) (kHz) | Resonance | 530–2408 | 530–2408 | 853–1926 | 1175–1605 |
| | Anti-resonance | Less than 530 or more than 1605 | Less than 530 | 117–530 | 220–477 |
| FM (76–90) (MHz) (Japan) | Resonance | 76–135 | 76–135 | 80.2–108 | 84.4–90 |
| | Anti-resonance | Less than 76 or more than 90 | Less than 76 | 42.8–76 | 51.1–68.4 |
| FM (88–108) (MHz) (U.S.A) | Resonance | 88–162 | 88–162 | 94–129.6 | 100–108 |
| | Anti-resonance | Less than 88 or more than 108 | Less than 88 | 47.8–88 | 57.8–79.2 |

The impedance given by the antenna conductors 6, the defogger 3 and so on is fixed. Accordingly, in order to satisfy the above-mentioned conditions, the position of the anti-resonance point and/or the resonance point is adjusted by changing the circuit constant of the matching circuit 7 and the reactance circuit 8.

In the matching circuit 7, it is preferable to set 560 pF–1 μF for the capacitor 19, 5 pF–220 pF for the capacitor 16, 82 μH–700 μH for the coil 14, 200Ω–10 KΩ for the resistor 15 in the AM band region, and 0.1 μH–10 μH for the coil 18 in the FM band region. On the other hand, it is preferable to set 0.1 mH–5 mH for the choke coil of the heater transformer 8 connected to the defogger 3 in the AM band region, and 1 μH–5 μH for the coils 12*a*, 12*b* in the FM band region. Further, it is preferable to set 10 pF–1000 pF for the capacitive coupling portion between the adjacent portion 6*a* and the branch line 3*a* in both the FM and AM band regions. For the cable 25, a coaxial cable, a feeder line or the like is usually used.

The above-mentioned values are merely examples, and it is possible to change the values so as to obtain the optimum performance depending on a glass antenna device for an automobile to be used. It is preferable to suppress noises that the ground for the automobile body as a negative pole of the cable 25 is apart from the ground for the automobile body as a negative pole of the d.c. power source 10 by more than 30 cm, preferably more than 60 cm.

The matching circuit 7 causes resonance in association with the all elements functioning as the antenna and the input impedance of the receiver 20. In this case, the provision of the capacitor 19 renders the matching circuit 7 to be of a slight capacitive reactance whereby the matching circuit 7 functions as a low-pass filter to absorb noises. Thus, a noiseless antenna can be obtained.

Further, description will be made as to Q which determines the circuit constant of the matching circuit 7 or the reactance circuit 8. It is preferable to set the difference between the highest receiving sensitivity and the lowest receiving sensitivity in a band region such as a desired receiving frequency band region to be in a range of about 1 dB–about 16 dB. With the value range, the receiving sensitivity is substantially flat in the predetermined receiving frequency band region.

When the difference between the highest receiving sensitivity and the lowest receiving sensitivity is less than about 1 dB, the effect of anti-resonance and resonance are not substantially obtainable, and the average receiving sensitivity will decrease by several dB–ten and several dB. On the other hand, when the difference between the highest receiving sensitivity and the lowest receiving sensitivity exceeds about 16 dB, the fluctuation of the receiving sensitivity becomes large. Further, in a large scale production, there is a large fluctuation in the frequency characteristic of receiving sensitivity in individual products. A desirable range of the difference between the highest receiving sensitivity and the lowest receiving sensitivity should be in a range of about 2 dB–about 13 dB, and more preferably, in a range of about 4 dB–about 10 dB. Thus, by setting the difference between the highest receiving sensitivity and the lowest receiving sensitivity to be in the above-mentioned range, the efficiency of power supplied from the antenna composed of the antenna conductors 6 and so on to the receiver 20 can be well, and signals can be received with a high receiving sensitivity because an intermediate or a high frequency current of receiving signals of coming radio waves, which are produced in the antenna, can be delivered to the receiver 20 without a leak current.

In accordance with the present invention, a leak current in the defogger 3 is minimized by anti-resonance caused in an area other than a predetermined broadcast frequency band region, and resonance is caused by utilizing the matching circuit between the frequency of 1.5 times of $f_H$ and $f_L$ in the predetermined broadcast frequency band region, whereby an excellent receiving sensitivity can be maintained over the entire region of the broadcast frequency band region. The reason why the above-mentioned measures are taken is that when the reactance circuit 8 and the matching circuit 7 are used solely, it is not possible to cover the entire region of the predetermined broadcast frequency band region.

When the anti-resonance is caused by utilizing the reactance circuit 8, the receiving sensitivity rapidly attenuates in a region lower than the anti-resonance point. Accordingly, it is preferable to cause the anti-resonance in a lower region out of a band region such as a predetermined receiving frequency band region. For simplifying description, a case of receiving both AM and FM radio wave broadcasting signals and of causing anti-resonance in a low frequency region, will be described.

The present invention is based on the technical idea as follows. The anti-resonance is caused in the above-mentioned low frequency region by the elements constituting the antenna and the reactance circuit 8 having an impedance whereby a receiving current induced in the defogger is prevented from flowing to the ground of the automobile body, and at the same time, the resonance is caused in the predetermined frequency band region by the elements constituting the antenna and the matching circuit whereby the receiving sensitivity is improved.

In the glass antenna device for an automobile of the present invention, an anti-resonance phenomenon is produced in an area out of a predetermined receiving frequency band region by impedance composed mainly of capacitance which is produced in correlation among three factors, i.e. the antenna conductors 6, the defogger 3 and the body of automobile, namely, the opening of the rear window and the impedance of the reactance circuit.

In the reactance circuit 8, for instance, since the inductance of the coils 12*a*, 12*b* is sufficiently smaller than the inductance of the heater transformer 9 in the AM band region, the inductance of the coils 12*a*, 12*b* can be neglected. Further, the heater transformer 9 is low in self-resonance frequency in the FM region and exhibits a capacitive reactance. Accordingly, the coils 12*a*, 12*b* function to block a high frequency current.

In the above-mentioned case, when the value of Q is made small in each broadcast band region of FM and AM, the receiving sensitivity is flattened in each broadcast band region of FM and AM whereby an amount of leak current is averaged and reduced. The leak current is an intermediate or a high frequency current of receiving signals induced in the defogger, which leaks to the automobile body side.

The defogger 3 and the antenna conductors 6 are in a state of connection in terms of an intermediate or a high frequency in both FM and AM broadcast bands due to the capacitive coupling between the adjacent portion 6*a* and the branch line 3*a* of the defogger. Further, the defogger 3 is electrically isolated from the ground of the automobile body by both the FM and AM broadcast bands, and accordingly, the defogger 3 functions as an antenna in the same manner as the antenna conductors 6.

The resonance in the AM band and the FM band will be described in detail by exemplifying the matching circuit 7 shown in FIG. 1.

The capacitor 16 exhibits a relatively high impedance in an AM band and it assumes as if not disposed. Accordingly, the impedance of the matching circuit 7 is determined by the coil 14 and the resistor 15. The resonance frequency at the resonance point is determined by the impedance of the matching circuit 7, the impedance of all elements functioning as the antenna (the impedance of the antenna conductor side viewed from the predetermined circuit) and the input impedance of the receiver 20. Further, Q becomes the optimum value by the resistor 15 as a damping resistor. Thus, the receiving sensitivity having excellent flatness in the AM band can be obtained.

In the FM band, the capacitor 16, the coil 14 and the resistor 15 exhibit a slight capacitive reactance due to the stray capacitance in each of the elements, namely, they exhibit an unstable impedance. On the other hand, the capacitor 16 becomes in a short-circuit state in the FM band and accordingly, the impedance of the coil 14 and the resistor 15 is negligible. Since only the coil 18 is effective in the matching circuit 7 in the FM band, resonance is caused by the coil 18, all elements constituting the antenna and the input impedance of the receiver 20, whereby signals received by the antenna can be transmitted to the receiver 20. Thus, a high receiving sensitivity can be obtained.

In the following, some Examples are described. However, the present invention is not limited to the Examples.

(EXAMPLE)

The glass antenna device for an automobile shown in FIG. 1 was used. Conditions for each sample are described in Table 2 wherein the choke coil of the heater transformer 9 is referred simply to a choke coil.

Samples 1 through 7 are for an AM band. As the elements constituting the circuit, the capacitor 19 of a capacitance of 1000 pF, the capacitor 16 of a capacitance of 10 pF, the capacitive coupling portion between the adjacent portion 6*a* and the branch line 9*a* of a capacitance of 90 pF and the capacitor 11 of a capacitance of 2.2 $\mu$F were used. The values of coil 14 and resistor 15, the inductance of the choke coil of the heater transformer 9 and the resistors 30, 31 are described in Table 2.

The capacity of an antenna-cable portion between the power feeding terminal 4 of the antenna conductors 6 and the input terminal of the receiver 20 was 30 pF/m in the AM band. The receiving sensitivity of the glass antenna device in the AM band is shown in FIGS. 2 through 8, and a result obtained by measuring the S/N ratio characteristics is shown in FIG. 17.

In samples 1 through 4, since the anti-resonance point is apart from the AM band, there is no substantial influence in receiving signals in the AM band by noises produced in the vicinity of the anti-resonance point. Samples 3 and 4 show a high quality of flatness and received signals very well.

FIG. 2 through 8 are respectively frequency characteristic diagrams wherein the receiving sensitivity in the AM band in an electric field having an intensity of 60 dB$\mu$V/m near the glass antenna is obtained for each frequency. It is understood that the receiving sensitivity is generally large in comparison with the frequency characteristic diagram in FIG. 4 wherein a conventional glass antenna with a pre-amplifier (referred to simply as glass antenna with amplifier) is used.

Figure 17:
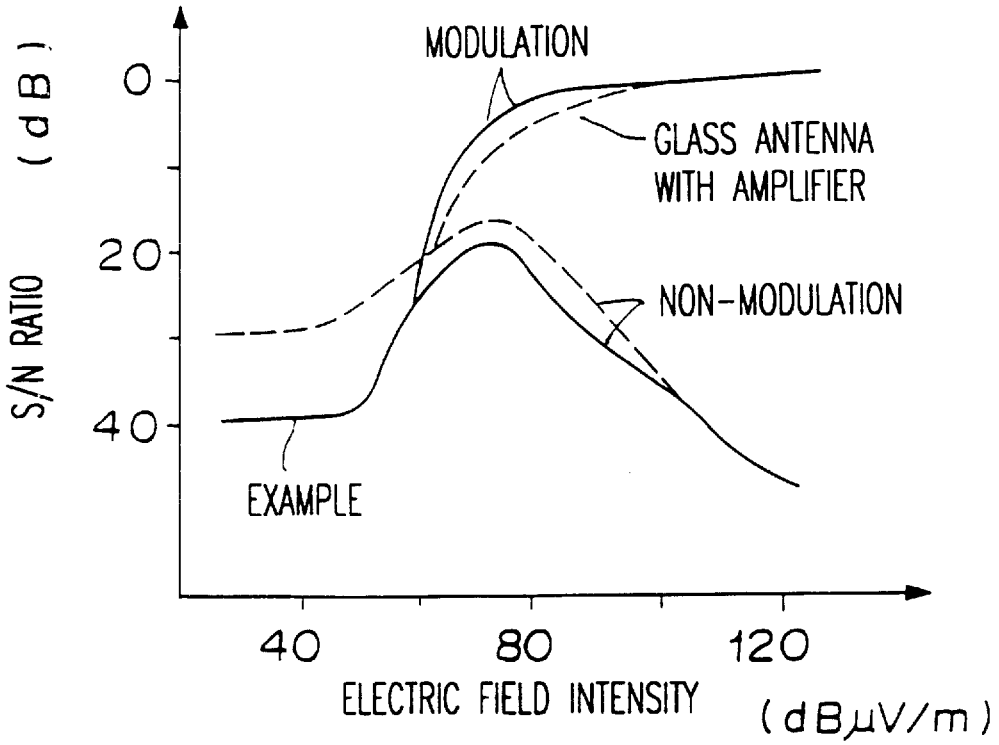
FIG. 17 is a characteristic diagram of the S/N ratio of the sample 5.

FIG. 17 is a graph showing the S/N ratio in a non-modulation time and a modulation time for each electric field intensity wherein the carrier wave frequency of sample 5 is 400 Hz. In this case, the non-modulation means the degree of modulation=0 and the modulation means the degree of modulation=30%. Regarding the S/N ratio, there is no substantial difference between the sample 5 and the conventional glass antenna with amplifier in a strong electric field. However, the glass antenna device (sample 5) of the present invention shows a good result in a weak electric field.

Figure 8:
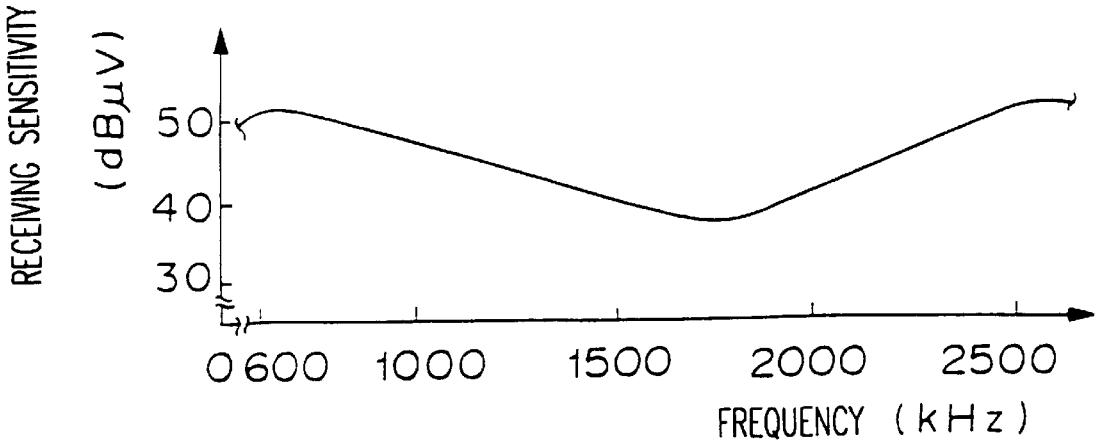
FIG. 8 is a frequency characteristic diagram of the receiving sensitivity of a sample 7.

Sample 7 is a Comparative Example whose frequency characteristic is as in FIG. 8. Since the anti-resonance point (600 KHz) exists in the AM band, noises produced in the vicinity of the anti-resonance point give influence on receiving signals in the AM band.

The S/N ratio at the anti-resonance point (600 KHz) of sample 7(FIG. 8) as a Comparative Example was about 2 dB behind the S/N ratio of the anti-resonance point (600 KHz) of sample 3 (FIG. 4) as an Example.

Thus, the glass antenna device of the present invention could provide the same or higher level of receiving sensitivity than the conventional glass antenna with amplifier which intends to improve the receiving sensitivity by disposing a pre-amplifier for the AM band. Further, the glass antenna device of the present invention could receive signals of a low noise level in an ordinary weak electric field.

In receiving signals in the AM band, the circuit constants were determined under conditions of 1700 KHz of anti-resonance point and 800 KHz of a resonance point, and the frequency characteristics of the receiving sensitivity were measured (not shown in drawing). As a result, the difference between the highest receiving sensitivity and the lowest receiving sensitivity in the AM band was about 16 dB, and signals could be received well.

For the FM band, samples 8 through 12 correspond to the frequency band of 76–90 MHz, and samples 13 through 15 correspond to the frequency band of 88–108 MHz. The value of each element effective in the FM band is as follows. In the FM band, the capacitor 19 of a capacitance of 10000 pF, the capacitor 16 of a capacitance of 10 pM and an antenna-cable portion between the power feeding terminal 4 of the antenna conductors 6 and the input terminal of the receiver 20 of 30 pF/m were used. The value of coil 18 and coils 12*a* and 12*b* are described in Table 2.

Figure 18:
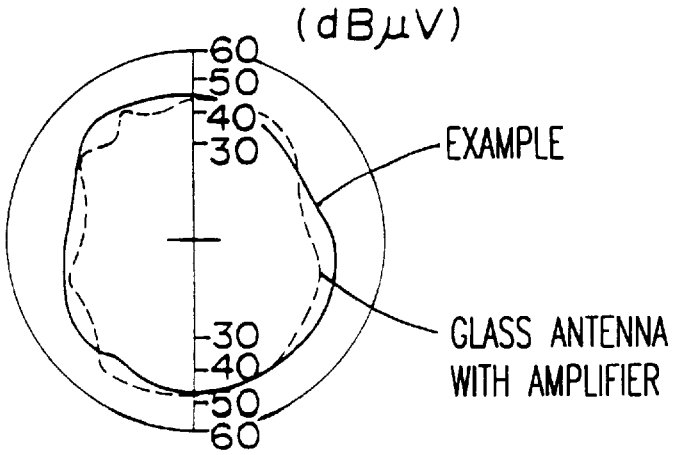
FIG. 18 is a characteristic diagram of the directivity of the sample 10.

FIGS. 9 through 16 are diagrams showing the frequency characteristics of the receiving sensitivity of the antenna in the FM band. Since the anti-resonance point of samples 8 through 10 and samples 13 and 14 is apart from the FM band, noises produced in the vicinity of the anti-resonance point do not substantially influence on receiving signals in the FM band. Samples 10 and 14 had a high level of flatness and could receive signals very well. The directivity of sample 10 is shown in FIG. 18, which verified that the glass antenna device of the present invention was of a high level of receiving sensitivity and non-directivity.

The S/N ratio of the anti-resonance point (80 MHz) of samples 12 (FIG. 13) as a Comparative Example was about 1 dB behind the S/N ratio of 80 MHz of sample 10 (FIG. 11) as an Example.

TABLE 2

Definition of rank: Preferable range = C, More preferable range = B, Particularly preferable range = A and Comparative Example = D

Figure 2:
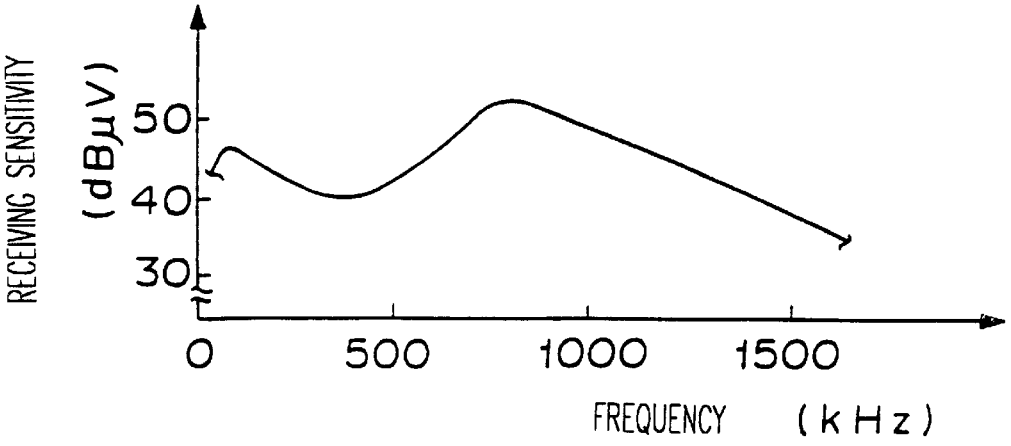
FIG. 2 is a frequency characteristic diagram of the receiving sensitivity of a sample 1.
Figure 3:
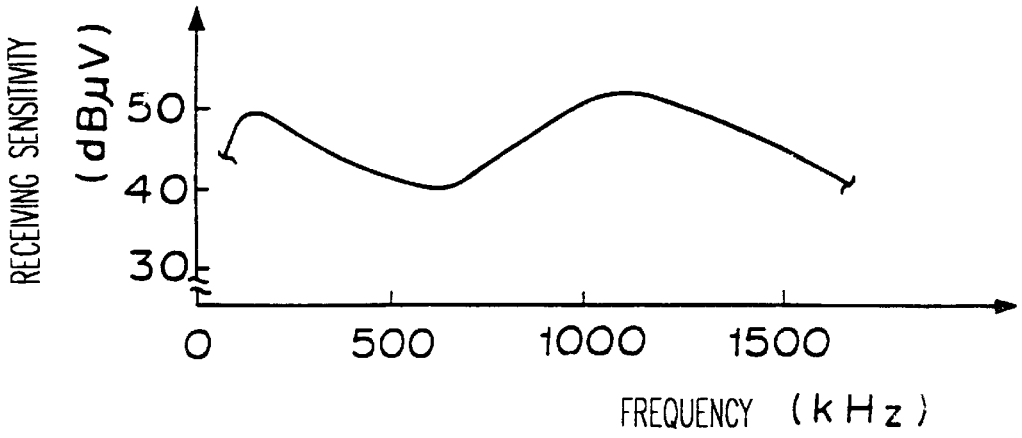
FIG. 3 is a frequency characteristic diagram of the receiving sensitivity of a sample 2.
Figure 4:
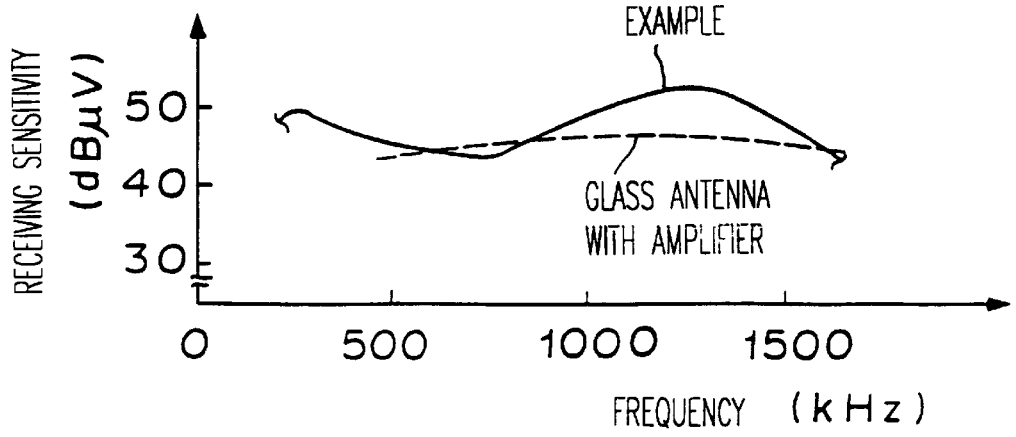
FIG. 4 is a frequency characteristic diagram of the receiving sensitivity of a sample 3.
Figure 5:
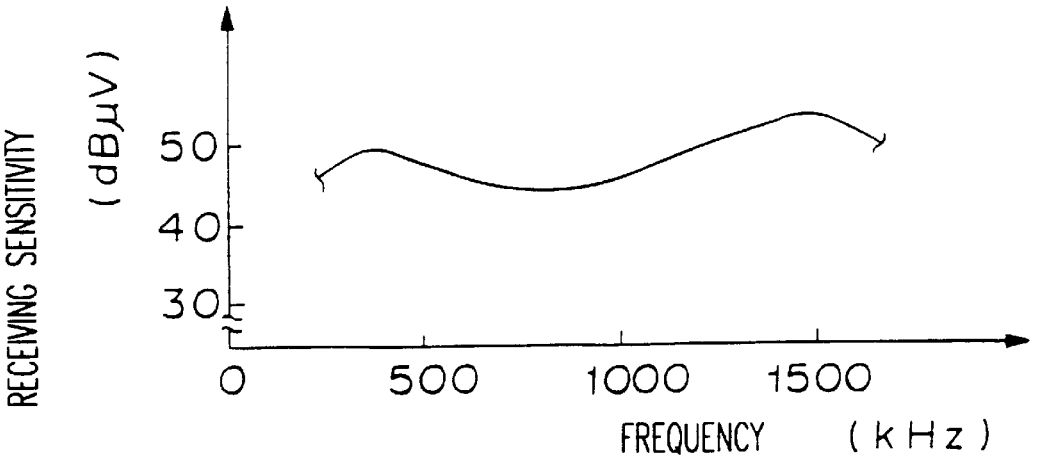
FIG. 5 is a frequency characteristic diagram of the receiving sensitivity of a sample 4.

| Sample No. | Broadcast frequency band region | Rank | Anti-resonance | Resonance | Receiving sensitivity-frequency characteristic diagram | Circuit constant |
|---|---|---|---|---|---|---|
| 1 | AM (530–1605) (kHz) | C | 80 KHz | 800 KHz | FIG. 2 | Coil 14 = 630 $\mu$H, Resistance 15 = 11 k$\Omega$, Choke coil = 12.80 mH, Resistance 30,31 = 83 k$\Omega$ |
| 2 | | B | 150 KHz | 1040 KHz | FIG. 3 | Coil 14 = 370 $\mu$H, Resistance 15 = 6.7 k$\Omega$, Choke coil = 3.65 mH, Resistance 30,31 = 44 k$\Omega$ |
| 3 | | A | 250 KHz | 1250 KHz | FIG. 4 | Coil 14 = 260 $\mu$H, Resistance 15 = 5.7 k$\Omega$, Choke coil = 1.30 mH, Resistance 30,31 = 26 k$\Omega$ |
| 4 | | A | 370 KHz | 1500 KHz | FIG. 5 | Coil 14 = 180 $\mu$H, Resistance 15 = 4.7 k$\Omega$, Choke coil = 600 $\mu$H Resistance 30,31 = 18 k$\Omega$ |

TABLE 2-continued

Definition of rank: Preferable range = C, More preferable range = B, Particularly preferable range = A and Comparative Example = D

Figure 6:
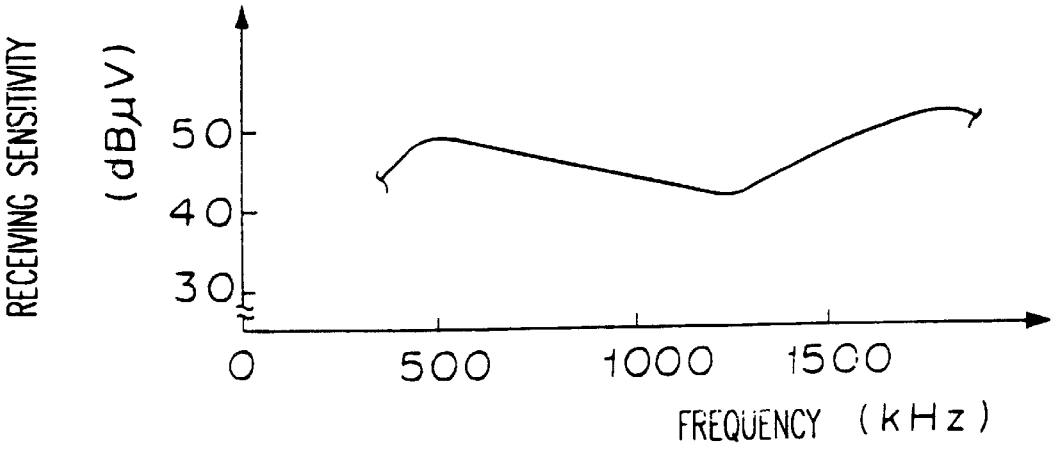
FIG. 6 is a frequency characteristic diagram of the receiving sensitivity of a sample 5.
Figure 7:
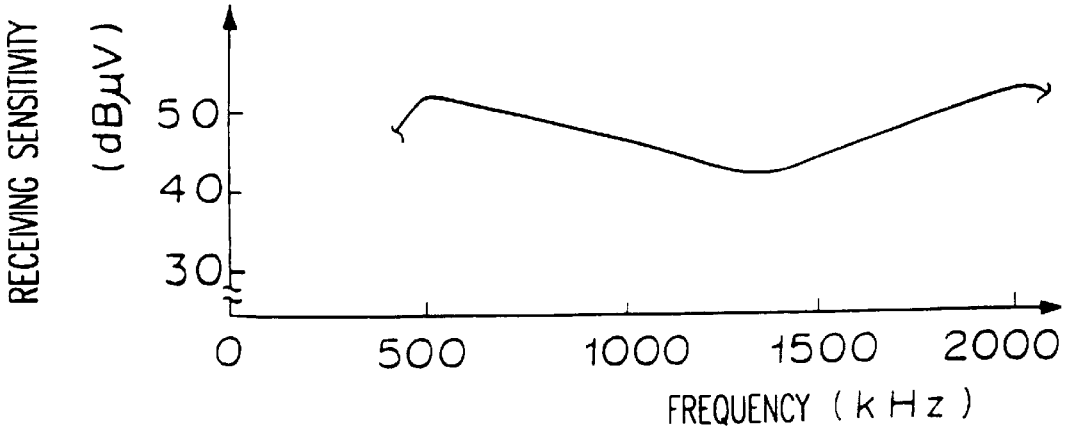
FIG. 7 is a frequency characteristic diagram of the receiving sensitivity of a sample 6.
Figure 9:
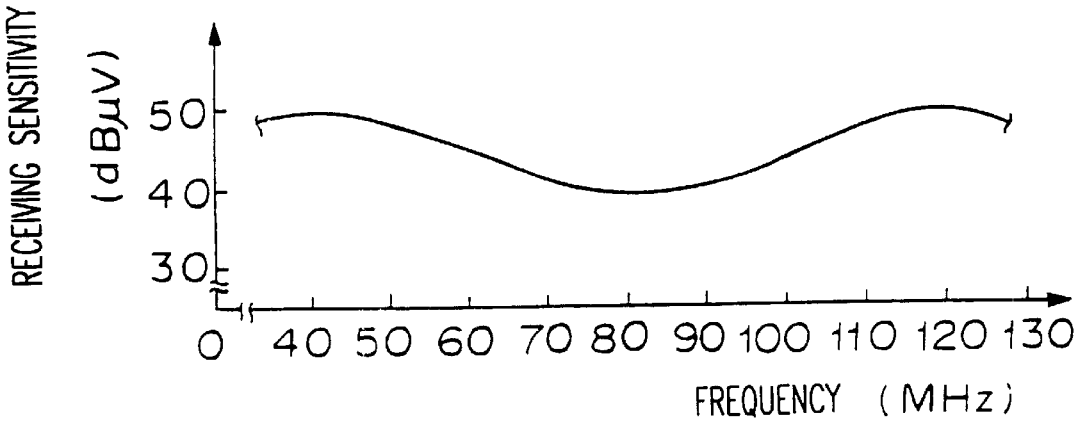
FIG. 9 is a frequency characteristic diagram of the receiving sensitivity of a sample 8.
Figure 10:
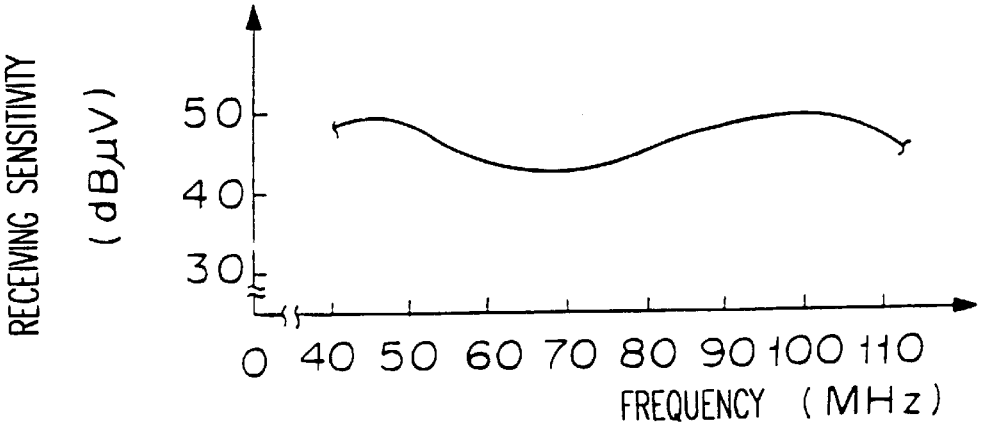
FIG. 10 is a frequency characteristic diagram of the receiving sensitivity of a sample 9.
Figure 11:
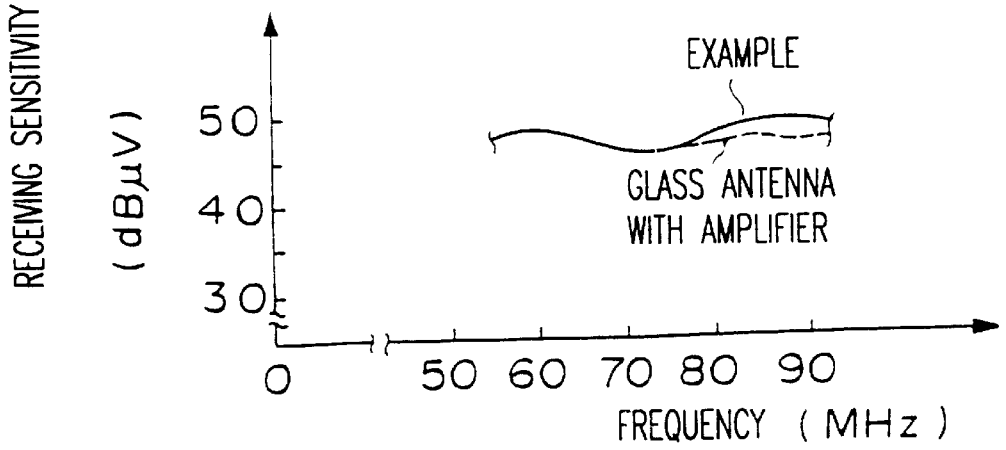
FIG. 11 is a frequency characteristic diagram of the receiving sensitivity of a sample 10.
Figure 12:
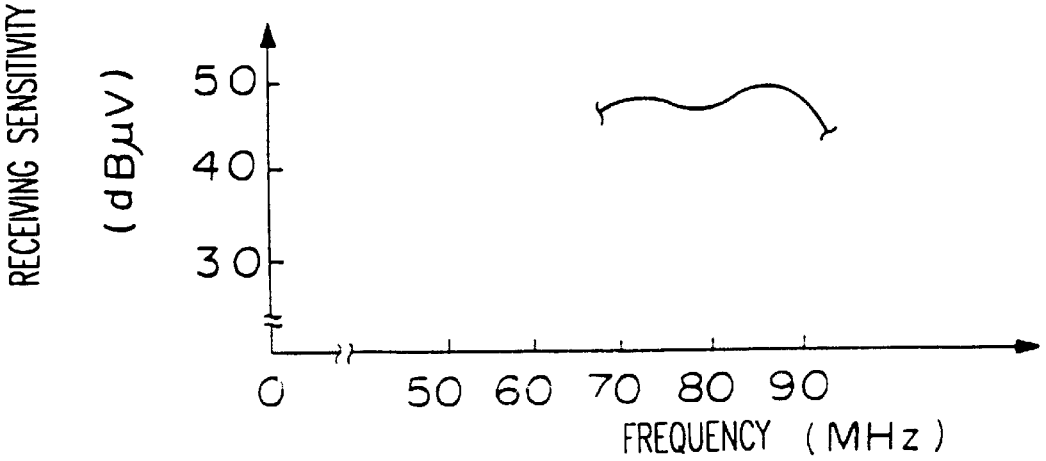
FIG. 12 is a frequency characteristic diagram of the receiving sensitivity of a sample 11.
Figure 13:
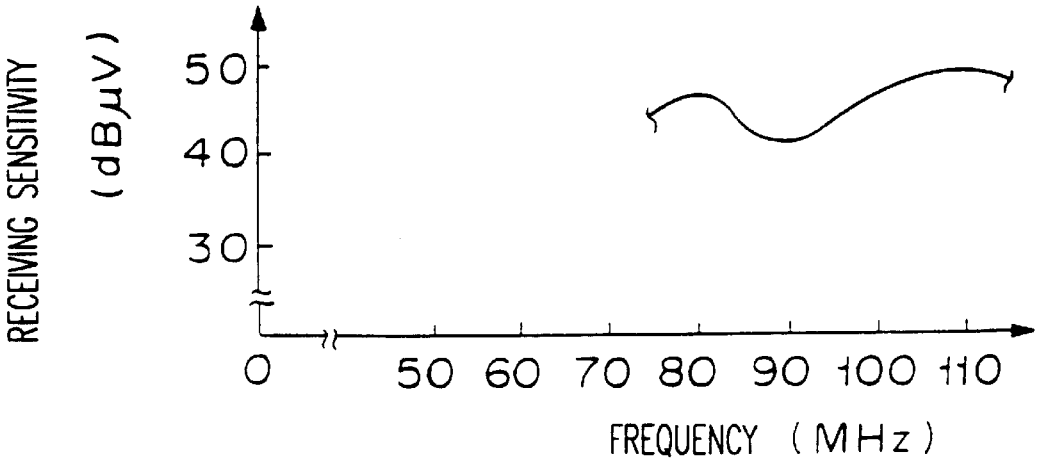
FIG. 13 is a frequency characteristic diagram of the receiving sensitivity of a sample 12.
Figure 14:
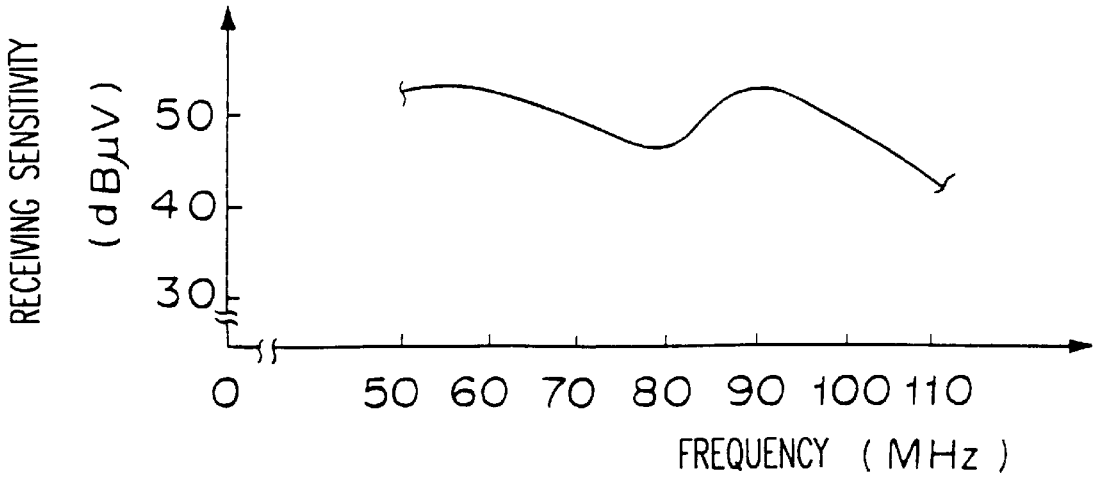
FIG. 14 is a frequency characteristic diagram of the receiving sensitivity of a sample 13.
Figure 15:
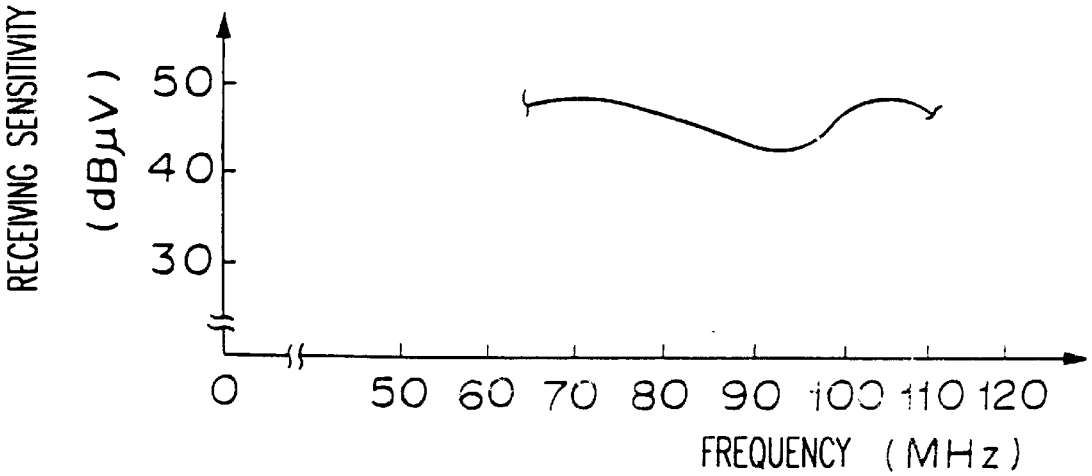
FIG. 15 is a frequency characteristic diagram of the receiving sensitivity of a sample 14.
Figure 16:
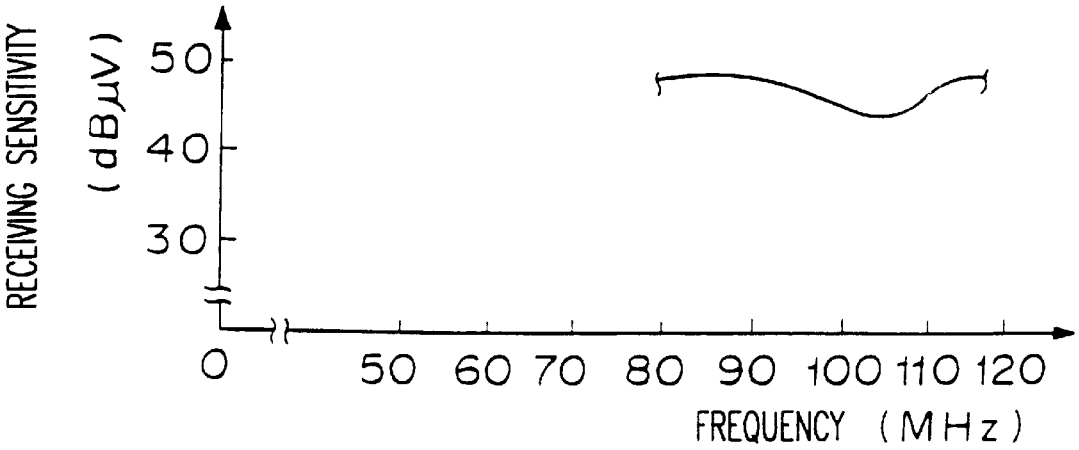
FIG. 16 is a frequency characteristic diagram of the receiving sensitivity of a sample 15.

| Sample No. | Broadcast frequency band region | Rank | Anti-resonance | Resonance | Receiving sensitivity-frequency characteristic diagram | Circuit constant |
|---|---|---|---|---|---|---|
| 5 | | B | 500 KHz | 1800 KHz | FIG. 6 | Coil 14 = 125 μH, Resistance 15 = 3.9 kΩ, Choke coil = 330 μH, Resistance 30,31 = 13 kΩ |
| 6 | | C | 500 KHz | 2040 KHz | FIG. 7 | Coil 14 = 97 μH, Resistance 15 = 3.4 kΩ, Choke coil = 330 μH, Resistance 30,31 = 13 kΩ |
| 7 | | D | 600 KHz | 2600 KHz | FIG. 8 | Coil 14 = 60 μH, Resistance 15 = 2.7 kΩ, Choke coil = 230 μH, Resistance 30,31 = 11 kΩ |
| 8 | FM (76–90) (MHz) | C | 40 MHz | 120 MHz | FIG. 9 | Coil 18 = 0.29 μH, Coil 12a, 12b = 1.78 μH |
| 9 | | B | 46 MHz | 100 MHz | FIG. 10 | Coil 18 = 0.35 μH, Coil 12a, 12b = 1.35 μH |
| 10 | | A | 60 MHz | 88 MHz | FIG. 11 | Coil 18 = 0.395 μH, Coil 12a, 12b = 0.79 μH |
| 11 | | B | 73 MHz | 86 MHz | FIG. 12 | Coil 18 = 0.40 μH, Coil 12a, 12b = 0.54 μH |
| 12 | | D | 80 MHz | 110 MHz | FIG. 13 | Coil 18 = 0.31 μH, Coil 12a, 12b = 0.45 μH |
| 13 | FM (88–108) (MHz) | B | 55 MHz | 90 MHz | FIG. 14 | Coil 18 = 0.390 μH, Coil 12a, 12b = 0.95 μH |
| 14 | | A | 70 MHz | 104 MHz | FIG. 15 | Coil 18 = 0.33 μH, Coil 12a, 12b = 0.59 μH |
| 15 | | B | 85 MHz | 115 MHz | FIG. 16 | Coil 18 = 0.30 μH, Coil 12a, 12b = 0.40 μH |

In accordance with the present invention, a glass antenna device for an automobile can be provided wherein a high gain, a low noise and a high receiving performance with non-directivity can be obtained without a pre-amplifier in a predetermined receiving frequency band region or a predetermined broadcast frequency band region. In particular, AM broadcast waves can be received with a high receiving sensitivity and a low noise level.

Further, the glass antenna device can receive FM broadcast waves with a high receiving sensitivity and non-directivity, and flatness in frequency characteristics of the receiving sensitivity is excellent. The glass glass antenna device is also applicable to radio waves as well. Accordingly, the pre-amplifier which was essential in a conventional glass antenna device can be omitted, which contributes productivity.

In the conventional glass antenna device, there was a restriction in designing an automobile when the pre-amplifier is installed in the vicinity of the glass antenna. However, in accordance with the present invention, a restriction can be eliminated since a simple circuit is used.

Further, according to the present invention, the frequency characteristics of receiving sensitivity having a high level of flatness can be obtained without reducing the receiving sensitivity over a wide band region such as a predetermined broadcast frequency band region. In addition, since the anti-resonance point is not included in the band region such as the predetermined broadcast frequency region, there is little influence by noises produced near the anti-resonance point, and desired broadcast waves can be received at a low noise level.

We claim:

1. A glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, wherein an anti-resonance frequency is generated to increase sensitivity for receiving signals in a predetermined receiving frequency band region or a predetermined broadcast frequency band region, by an impedance composed mainly of a capacitance generated based on positioning of the antenna conductors, the defogger and a body of the automobile and an impedance of the reactance circuit, and wherein a resonance frequency is generated to increase sensitivity for receiving signals in the predetermined receiving frequency band region or the predetermined broadcast frequency band region, by an impedance of a predetermined circuit connected between a power feeding terminal for the antenna conductors and a receiver; an input impedance of the receiver and an impedance of the antenna conductors side viewed from the predetermined circuit; and wherein the reactance circuit includes a primary and secondary side choke coil and the primary side choke coil of the reactance circuit is connected between a bus bar and a cathode of the d.c. power source, the secondary side choke coil is connected between another bus bar and an anode of the d.c. power source, and a resistor is connected in parallel to each of the primary side and secondary side choke coils whereby a quality factor value for anti-resonance is adjusted by changing values of the resistors.

2. The glass antenna device for an automobile according to claim 1, wherein a circuit constant of the predetermined circuit and the reactance circuit are set to determine a quality factor value so that a difference between a highest receiving sensitivity and a lowest receiving sensitivity in the predetermined receiving frequency band region or the predetermined broadcast frequency band region is in a range of from about 4 dB to about 10 dB.

3. The glass antenna device for an automobile according to claim 1, wherein the predetermined circuit comprises a circuit of a coil, a resistor and a capacitor which are connected in parallel.

4. The glass antenna device for an automobile according to claim 3, wherein in an AM broadcast frequency band region, an inductance value of the coil is 82–700 $\mu$H, a resistance value of the resistor is 200 Ω–10 kΩ, and a capacitance value of the capacitor is 5–220 pF.

5. The glass antenna device for an automobile according to claim 1, wherein the predetermined circuit comprises a first circuit comprising a capacitor connected in series to a circuit in which a coil and a resistor are connected in parallel, and a capacitor is connected in parallel to the first circuit.

6. The glass antenna device for an automobile according to claim 1, wherein the predetermined circuit comprises a parallel connection of a first circuit, a resistor and a capacitor where the first circuit includes a serial connection of a coil and a capacitor.

7. The glass antenna device for an automobile according to claim 1, wherein the reactance circuit comprises a choke coil, and a capacitor is connected in parallel to the choke coil to adjust the self-resonance frequency or a Q (quality factor).

8. A glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, the reactance circuit comprising a choke coil and a high frequency coil being connected between a bus bar and the choke coil, wherein an anti-resonance frequency is generated to increase sensitivity for receiving signals in a predetermined receiving frequency band region or a predetermined broadcast frequency band region, by an impedance composed mainly of a capacitance generated based on a positioning of the antenna conductors, the defogger and a body of the automobile and an impedance of the reactance circuit, and wherein a resonance frequency is generated to increase sensitivity for receiving signals in the predetermined receiving frequency band region or the predetermined broadcast frequency band region, by an impedance of a predetermined circuit connected between a power feeding terminal for the antenna conductors and a receiver; an input impedance of the receiver and an impedance of the antenna conductor side viewed from the predetermined circuit.

9. The glass antenna device for an automobile according to claim 8, wherein a circuit constant of the predetermined circuit and the reactance circuit are set to determine a quality factor value so that a difference between a highest receiving sensitivity and a lowest receiving sensitivity in the predetermined receiving frequency band region or the predetermined broadcast frequency band region is in a range of from about 4 dB to about 10 dB.

10. The glass antenna device for an automobile according to claim 8, wherein the predetermined circuit comprises a circuit of a coil, a resistor and a capacitor which are connected in parallel.

11. The glass antenna device for an automobile according to claim 10, wherein in an Am broadcast frequency band region, an inductance value of the coil is 82–700 $\mu$H, a resistance value of the resistor is 200 Ω–10 kΩ, and a capacitance value of the capacitor is 5–220 pF.

12. The glass antenna device for an automobile according to claim 8, wherein the predetermined circuit comprises a first circuit comprising a capacitor connected in series to a circuit in which a coil and a resistor are connected in parallel, and a capacitor is connected in parallel to the first circuit.

13. The glass antenna device for an automobile according to claim 8, wherein the predetermined circuit comprises a parallel connection of a first circuit, a resistor and a capacitor where the first circuit includes a serial connection of a coil and a capacitor.

14. The glass antenna device for an automobile according to claim 2, wherein the reactance circuit comprises a choke coil, and a capacitor is connected in parallel to the choke coil to adjust the self-resonance frequency or a Q (quality factor).

15. A glass antenna device for an automobile comprising:

a glass sheet fitted to a rear window opening of an automobile;

an electric heating type defogger having heater strips and bus bars for feeding a current to the heater strips;

antenna conductors arranged to have a pattern and spaced with a predetermined distance apart from the defogger in a capacitive coupling relation so that a direct current is not caused to flow but an intermediate or a high frequency current is caused to flow between the antenna conductors and the defogger, the defogger and the antenna conductors being formed on the glass sheet; and a reactance circuit connected between the bus bars and a d.c. power source for the defogger, wherein an anti-resonance frequency is generated to increase sensitivity for receiving signals in a predetermined receiving frequency band region or a predetermined broadcast frequency band region, by an impedance composed mainly of a capacitance generated based on a positioning of the antenna conductors, the defogger and a body of the automobile and an impedance of the reactance circuit;

wherein a resonance frequency is generated to increase sensitivity for receiving signals in the predetermined receiving frequency band region or the predetermined broadcast frequency band region, by an impedance of a predetermined circuit connected between a power feeding terminal for the antenna conductors and a receiver; an input impedance of the receiver and an impedance of the antenna conductor side viewed from the predetermined circuit; and wherein a circuit constant of the predetermined circuit and the reactance circuit are set to determine a quality factor value so that a difference between a highest receiving sensitivity and a lowest receiving sensitivity in the predetermined receiving frequency band region or the predetermined broadcast frequency band region is in a range of from about 4 dB to about 10 dB.

16. The glass antenna device for an automobile according to claim 15, wherein the predetermined circuit comprises a circuit of a coil, a resistor which are connected in parallel.

17. The glass antenna device for an automobile according to claim 16, wherein in an AM broadcast frequency band region, an inductance value of the coil is 82–700 $\mu$H, a resistance value of the resistor is 200 Ω–10 kΩ, and a capacitance value of the capacitor is 52–20 pF.

18. The glass antenna device for an automobile according to claim 15, wherein the predetermined circuit comprises a first circuit comprising a capacitor connected in series to a circuit in which a coil and a resistor are connected in parallel, and a capacitor is connected in parallel to the first circuit.

19. The glass antenna device for an automobile according to claim 15, wherein the predetermined circuit comprises a parallel connection of a first circuit, a resistor and a capacitor where the first circuit includes a serial connection of a coil and a capacitor.

20. The glass antenna device for an automobile according to claim 15, wherein the reactance circuit comprises a choke coil, and a capacitor is connected in parallel to the choke coil to adjust the self-resonance frequency or a Q (quality factor).

* * * * *